United States Patent [19]

Schoerner et al.

[11] 4,080,223

[45] Mar. 21, 1978

[54] ALUMINUM-NICKEL-IRON ALLOY ELECTRICAL CONDUCTOR

[75] Inventors: Roger John Schoerner; Enrique C. Chia, both of Carrollton, Ga.

[73] Assignee: Southwire Company, Carrollton, Ga.

[21] Appl. No.: 703,389

[22] Filed: Jul. 8, 1976

Related U.S. Application Data

[63] Continuation-in-part of Ser. No. 589,651, Jun. 23, 1975, abandoned, which is a continuation-in-part of Ser. No. 150,724, Jun. 7, 1971, abandoned, which is a continuation-in-part of Ser. No. 147,196, May 26, 1971, abandoned.

[51] Int. Cl.[2] ..... C22F 1/04

[52] U.S. Cl. ..... 148/2; 29/527.7; 75/138; 75/142; 75/143; 75/144; 75/147; 75/148; 148/11.5 A; 148/32; 148/32.5

[58] Field of Search ..... 75/138, 139, 142, 143, 75/144, 147, 148; 148/2, 3, 11.5 A, 32, 32.5; 29/527.7; 164/76

[56] References Cited

U.S. PATENT DOCUMENTS

| | | | |
|---|---|---|---|
| 1,579,481 | 4/1926 | Hybinette | 75/138 |
| 3,512,221 | 5/1970 | Schoerner | 148/2 |
| 3,697,260 | 10/1972 | Hunsicker | 148/11.5 A |
| 3,771,214 | 11/1973 | Binger et al. | 75/144 |
| 3,807,969 | 4/1974 | Schoerner et al. | 75/138 |

*Primary Examiner*—R. Dean

*Attorney, Agent, or Firm*—Herbert M. Hanegan; Stanley L. Tate; R. Steven Linne

[57] ABSTRACT

Aluminum alloy electrical conductors are produced from aluminum base alloys containing from about 0.20 percent to about 1.60 percent by weight nickel, from about 0.30 percent to 1.30 percent iron, optionally up to about 1.00 percent of additional alloying elements, the remainder being aluminum with associated trace elements. The alloy conductors have an electrical conductivity of at least fifty-seven percent (57%), based on the International Annealed Copper Standard (IACS), and improved properties of increased thermal stability, tensile strength, percent ultimate elongation, ductility, fatigue resistance and yield strength as compared to conventional aluminum alloys of similar electrical properties.

8 Claims, No Drawings

ALUMINUM-NICKEL-IRON ALLOY ELECTRICAL CONDUCTOR

CROSS REFERENCE TO RELATED APPLICATIONS

This application is a continuation-in-part of our copending application Ser. No. 589,651, filed June 23, 1975, abandoned which in turn is a continuation-in-part of our copending application Ser. No. 150,724, filed June 7, 1971, which in turn is a continuation-in-part of our copending application Ser. No. 147,196, filed May 26, 1971, both now abandoned.

DESCRIPTION OF THE PREFERRED EMBODIMENTS

The present invention concerns an aluminum base alloy especially suited for producing high strength light-weight electrical conductors including wire, rod and other such articles of manufacture. The present alloy is particularly well suited for use as a wire, rod, cable, bus bar, tube connector, termination, receptacle plug or electrical contact device for conducting electricity.

Aluminum base alloys are finding wider acceptance in the marketplace of today because of their light weight and low cost. One area where aluminum alloys have found increasing acceptance is in the replacement of copper in the manufacture of electrically conductive wire. Conventional electrically conductive aluminum alloy wire (referred to as EC) contains a substantial amount of pure aluminum and trace amounts of impurities such as silicon, vanadium, iron, copper, manganese, magnesium, zinc, boron, and titanium.

Even though desirable in terms of weight and cost, aluminum alloys have received far less than complete acceptance in the electrical conductor marketplace. One of the chief reasons for the lack of complete acceptance is the range of physical properties available with conventional EC aluminum alloy conductors. If the physical properties, such as thermal stability, tensile strength, percent elongation, ductility and yield strength, could be improved significantly without substantially lessening the electrical conductivity of the finished product, a very desirable improvement would be achieved. It is accepted, however, that addition of most alloying elements, as in other aluminum alloys, reduces conductivity while improving the physical properties. Consequently, it was generally believed that only those additions of elements which improve physical properties without substantially lessening conductivity will yield an acceptable and useful product.

It is an object of the present invention, therefore, to provide a new and useful aluminum alloy electrical conductor which combines improved physical properties with acceptable electrical conductivity. These and other objects, features and advantages of the present invention will be apparent from a consideration of the following detailed description of an embodiment of the invention.

In accordance with the invention, the present aluminum base alloy is prepared by mixing nickel, iron and optionally other alloying elements with aluminum in a furnace to obtain a melt having requisite percentages of elements. It has been found that suitable results are obtained with nickel present in a weight percentage of from about 0.20 percent to about 1.60 percent. Superior results are achieved when nickel is present in a weight percentage of from about 0.20 percent to about 1.00 percent and particularly superior and preferred results are obtained when nickel is present in a percentage by weight of from about 0.30 percent to about 0.80 percent.

Suitable results are obtained with iron present in a weight percentage of from about 0.30 percent to about 1.30 percent. Superior results are achieved when iron is present in a weight percentage of from about 0.30 percent to about 1.00 percent and particularly superior and preferred results are obtained when iron is present in a percentage by weight of from about 0.45 percent to about 0.65 percent.

Suitable results are obtained when the combined total of nickel plus iron is greater than about 0.50 weight percent and less than about 2.90 weight percent. Superior results are achieved when the combined total of nickel and iron is greater than about 1.25 weight percent and less than about 2.00 weight percent.

The aluminum content of the present alloy may vary from about 97.00 percent to about 99.50 percent by weight with superior results being obtained when the aluminum content varies between about 97.80% and about 99.20% by weight. Since the percentages for maximum and minimum aluminum do not correspond with the maximums and minimums for alloying elements, it should be apparent that suitable results are not obtained if the maximum percentages for all alloying elements are employed. If commercial aluminum is employed in preparing the present melt, it is preferred that the aluminum, prior to adding to the melt in the furnace, contain no more than 0.10 percent total of trace impurities.

Copper and magnesium have a high solubility in aluminum at room temperature, consequently the electrical conductivity is usually decreased when they are present due to the known effect of atoms in solid solution to the electrical conductivity of aluminum. However, the present alloy may contain up to about 0.45 weight percent copper and up to about 0.45 weight percent magnesium, because these elements can now form tertiary and/or quaternary compounds with the nickel or iron present which can then precipitate from the solid solution and therefore no longer having such a detrimental effect on the electrical conductivity.

In fact, some amounts of copper and magnesium are especially useful when the amounts of nickel and iron are low because the additional intermetallic precipitates greatly improve the work hardening rate thereby strengthening the wrought product.

The present alloy may contain up to about 0.45 percent by weight each of additional alloying elements, the total weight percent of these additional alloying elements not exceeding about 0.725 percent. Superior results are obtained when the concentration of individual optional alloying elements is about 0.30 percent by weight or less and the total additional alloying elements not exceeding about 0.60 weight percent. Particularly superior and preferred results are obtained when the concentration of individual optional alloying elements is about 0.20 percent by weight or less and the total additional alloying elements not exceeding about 0.40 weight percent.

Additional alloying elements include the following:

| ADDITIONAL ALLOYING ELEMENTS | | |
|---|---|---|
| Antimony | Indium | Thallium |
| Beryllium | Magnesium | Thorium |

-continued

| ADDITIONAL ALLOYING ELEMENTS | | |
|---|---|---|
| Bismuth | Niobium | Tin |
| Boron | Rhenium | Titanium |
| Carbon | Rubidium | Yitrium |
| Cesium | Scandium | Zinc |
| Copper | Silicon | Zirconium |
| Hafnium | Tantalum | Misch Metal |
| | | Rare Earth Metal |

Superior results are obtained with the following additional alloying elements in the percentages, by weight, as shown:

| PREFERRED ADDITIONAL ALLOYING ELEMENTS | |
|---|---|
| Silicon | 0.001% to 0.45% |
| Zirconium | 0.001% to 0.45% |
| Niobium | 0.001% to 0.45% |
| Tantalum | 0.001% to 0.45% |
| Yitrium | 0.001% to 0.45% |
| Scandium | 0.001% to 0.45% |
| Thorium | 0.001% to 0.45% |
| Rare Earth Metals | 0.001% to 0.45% |
| Carbon | 0.001% to 0.45% |
| Copper | 0.001% to 0.45% |
| Magnesium | 0.001% to 0.45% |
| Mixtures of two or more of the above | 0.001% to 0.725% |

Particularly superior and preferred results are obtained with the use of silicon in a percentage range of from about 0.001 to about 0.45 percent by weight, additional alloying elements in a percentage range of from about 0.0005 to about 0.25 percent by weight, and copper or magnesium as additional alloying elements. Suitable results are obtained with magnesium or copper, in a percentage range of from about 0.0005 to about 0.45 percent by weight. Superior results are obtained with from about 0.025 to about 0.30 percent by weight magnesium or copper, silicon in a percentage range of from about 0.001 to about 0.30 by weight and from about 0.0005 to about 0.25 percent by weight additional alloying elements. Particularly superior and preferred results are obtained when from about 0.03 to about 0.10 percent by weight of magnesium or copper, is employed with from about 0.0001 to about 0.20 percent by weight silicon and from about 0.0005 to about 0.20 weight percent additional alloying elements.

Superior and preferred results are also obtained with the use of nickel and iron in the percentage ranges previously specified with additional alloying elements and optionally with silicon as the major additional alloying element.

Suitable results are obtained with the use of silicon as the major additional alloying element in a percentage range of from about 0.001 to about 0.45 percent by weight and from about 0.0005 to about 0.25 weight percent additional alloying elements, with superior results being obtained with from about 0.001 to about 0.30 weight percent silicon and from about 0.0005 to about 0.25 weight percent additional alloying elements. Particular superior and preferred results are obtained with from about 0.001 to about 0.20 weight percent silicon and from about 0.0005 to about 0.10 weight percent additional alloying elements.

When silicon is not the major additional alloying element suitable results are obtained with the use of nickel and iron in the percentage ranges previously specified and from about 0.0005 to about 0.725 weight percent additional alloying elements. Superior results are obtained with from about 0.0005 to 0.60 weight percent additional alloying elements, with particular superior and preferred results obtained with from about 0.0005 to about 0.40 weight percent additional alloying elements.

The rare earth metals or misch metal may be present either individually within the percentage range stated or as a partial or total group, the total percentage of the group being within the percentage range stated previously. Misch metal is a commercial designation for a blend of rare earth metals and thorium obtained during the processing of thorium metal.

It should be understood that the additional alloying elements may be present either individually or as a group of two or more elements. It should be understood, however, that if two or more of the additional alloying elements are employed, the total concentration of additional alloying elements should not exceed about 0.725 percent by weight.

However, when magnesium and copper are the additional alloying elements and when the total weight percent of nickel and iron is less than about 1.25 percent, the total weight percent of magnesium and copper should be at least about 0.725 percent by weight less the average amount of any effective nickel and iron present. This relationship is easily expressed as the equation:

$$\%Cu + 2 \times \%Mg + 0.25 \times \%Si \geqq 0.725 - 0.370 \times \%Fe - 0.185 \times \%Ni$$

When the total weight percent of nickel and iron exceeds about 1.80 percent the total weight percent of magnesium and copper should not exceed about 0.40 percent and the total weight percent of additional alloying elements should not exceed about 0.40 percent in order to maintain the desired electrical conductivity and physical properties.

If the total weight percent nickel and iron is about 2.90 percent the total weight percent of magnesium and copper should not exceed about 0.20 percent and the total weight percent of additional alloying elements should not exceed about 0.10 percent.

After preparing the melt, the aluminum alloy is preferably continuously cast into a continuous bar by a continuous casting machine and then substantially immediately thereafter, hot-worked in a rolling mill to yield a continuous aluminum alloy rod.

One example of a continuous casting and rolling operation capable of producing continuous rod as specified in this application is contained in the following paragraphs. It should be understood that other methods of preparation may be employed to obtain suitable results but that preferable results are obtained with continuous processing. Such other methods include conventional extrusion and hydrostatic extrusion to obtain rod or wire directly sintering an aluminum alloy powder to obtain rod or wire directly, casting rod or wire directly from a molten aluminum alloy, and conventional casting of aluminum alloy billets which are subsequently hot-worked to rod and drawn with intermediate anneals into wire.

CONTINUOUS CASTING AND ROLLING OPERATION

A continuous casting machine serves as a means for solidifying the molten aluminum alloy metal to provide a cast bar that is conveyed in substantially the condition in which it solidified from the continuous casting machine to the rolling mill, which serves as a means for hot-forming the cast bar into rod or another hot-formed product in a manner which imparts substantial movement to the cast bar along a plurality of angularly disposed axes.

The continuous casting machine is of conventional casting wheel type having a casting wheel with a casting groove in its periphery which is partially closed by an endless belt supported by the casting wheel and an idler pulley. The casting wheel and the endless belt cooperate to provide a mold into one end of which molten metal is poured to solidify and from the other end of which the cast bar is emitted in substantially that condition in which it solidified.

The rolling mill is of conventional type having a plurality of roll stands arranged to hot-form the cast bar by a series of deformations. The continuous casting machine and the rolling mill are positioned relative to each other so that the cast bar enters the rolling mill substantially immediately after solidification and in substantially that condition in which is solidified. In this condition, the cast bar is at a hot-forming temperature within the range of temperatures for hot-forming the cast bar at the initiation of hot-forming without heating between the casting machine and the rolling mill. In the event that it is desired to closely control the hot-forming temperature of the cast bar within the conventional rnage of hot-forming temperatures, means for adjusting the temperature of the cast bar may be placed between the continuous casting machine and the rolling mill without departing from the inventive concept disclosed herein.

The roll stands each include a plurality of rolls which engage the cast bar. The rolls of each roll stand may be two or more in number and arranged diametrically opposite from one another or arranged at equally spaced portions about the axis of movement of the cast bar through the rolling mill. The rolls of each roll stand of the rolling mill are rotated at a predetermined speed by a power means such as one or more electric motors and the casting wheel is rotated at a speed generally determined by its operating characteristics. The rolling mill serves to hot-form the cast bar into a rod of a cross-sectional area substantially less than that of the cast bar as it enters the rolling mill.

The peripheral surfaces of the rolls of adjacent roll stands in the rolling mill change in configuration; that is, the cast bar is engaged by the rolls of successive roll stands with surfaces of varying configuration, and from different directions. This varying surface engagement of the cast bar in the roll stands functions to knead or shape the metal in the cast bar in such a manner that it is worked at each roll stand and also to simultaneously reduce and change the cross-sectional area of the cast bar into that of the rod.

As each roll stand engages the cast bar, it is desirable that the cast bar be received with sufficient volume per unit of time at the roll stand for the cast bar to generally fill the space defined by the rolls of the roll stand so that the rolls will be effective to work the metal in the cast bar. However, it is also desirable that the space defined by the rolls of each roll stand will not be overfilled so that the cast bar will not be forced into the gaps between the rolls. Thus, it is desirable that the rod be fed toward each roll stand at a volume per unit of time which is sufficient to fill, but not overfill, the space defined by the rolls of the roll stand.

As the cast bar is received from the continuous casting machine, it usually has one large flat surface corresponding to the surface of the endless band and inwardly tapered side surfaces corresponding to the shape of the groove in the casting wheel. As the cast bar is compressed by the rolls of the roll stands, the cast bar is deformed so that it generally takes the cross-sectional shape defined by the adjacent peripheries of the rolls of each roll stand.

Thus, it will be understood that with this apparatus, cast aluminum alloy rod of an infinite number of different lengths is prepared by simultaneous casting of the molten aluminum alloy and hot-forming or rolling the cast aluminum bar. The continuous rod has a minimum electrical conductivity of 57 percent IACS and may be used in conducting electricity or it may be drawn to wire of a smaller cross-sectional diameter.

To produce wire of various gauges, the continuous rod produced by the casting and rolling operation is processed in a reduction operation. The unannealed rod (i.e., as rolled to *f* temper) is cold-drawn through a series of progressively constricted dies, without intermediate anneals, to form a continuous wire of desired diameter. It has been found that the elimination of intermediate anneals is preferable during the processing of the rod and improves the physical properties of the wire. Processing with intermediate anneals is acceptable when the requirements for physical properties of the wire permit reduced values. The conductivity of the hard-drawn wire is at least 57 percent IACS. If greater conductivity or increased elongation is desired, the wire may be annealed or partially annealed after the desired wire size is obtained and cooled. Fully annealed wire has a conductivity of at least 58 percent IACS. At the conclusion of the drawing operation and optional annealing operation, it is found that the alloy wire has the properties of improved tensile strength and yield strength together with improved thermal stability, percent ultimate elongation and increased ductility and fatigue resistance as specified previously in this application. The annealing operation may be continuous as in resistance annealing, induction annealing, convection annealing by continuous furnaces or radiation annealing by continuous furnaces, or, preferably, may be batch annealed in a batch furnace. When continuously annealing, temperatures of about 450° F to about 1200° F may be employed with annealing times of about five minutes to about 1/10,000 of a minute. Generally, however, continuous annealing temperatures and times may be adjusted to meet the requirements of the particular overall processing operation so long as the desired physical properties are achieved. In a batch annealing operation, a temperature of approximately 400° F to about 750° F is employed with residence times of about thirty (30) minutes to about twenty-four (24) hours. As mentioned with respect to continuous annealing, in batch annealing the times and temperatures may be varied to suit the overall process so long as the desired physical properties are obtained.

It has been found that the properties of a Number 10 gauge (American wire gauge) fully annealed soft wire of the present alloy vary between the following figures:

| Conductivity | Tensile Strength, psi. | % Elongation | Yield Strength, psi. |
|---|---|---|---|
| 58% 63+% | 12,000–24,000 | 12% – 30% | 8,000–18,000 |

A more complete understanding of the invention will be obtained from the following examples:

EXAMPLES

Various melts were prepared by adding the required amount of alloying elements to 1816 grams of molten aluminum, containing less than 0.10% trace element impurities, to achieve a percentage concentration of elements as shown in the accompanying table; the remainder being aluminum. Graphite crucibles were used except in those cases where the alloying elements were known carbide formers, in which cases aluminum oxide crucibles were used. The melts were held for sufficient times and at sufficient temperatures to allow complete solubility of the alloying elements with the base aluminum. An argon atmosphere was provided over the melt to prevent oxidation. Each melt was continuously cast on a continuous casting machine and immediately hot-rolled through a rolling mill to ⅜ inch continuous rod. Wire was then drawn and annealed from the rod (soft [annealed] wire from hard [as rolled] rod) for five hours at 650° F (soft wire). The final wire diameter obtained was 0.1019 inches, 10 gauge AWG.

The types of alloys employed and the results of the tests performed thereon are as follows:

TABLE I

| Number | Ni | Fe | Other | UTS | % Elong. | % IACS |
|---|---|---|---|---|---|---|
| 1 | 0.20 | 1.30 | — | 17,500 | 13.5 | 61.05 |
| 2 | 0.30 | 1.00 | — | 17,500 | 12.5 | 60.49 |
| 3 | 0.40 | 1.10 | — | 17,400 | 14.1 | 60.30 |
| 4 | 0.40 | 0.90 | .1 Mg | 20,260 | 19.6 | 58.8 |
| 5 | 0.60 | 1.00 | — | 20,016 | 19.9 | 60.09 |
| 6 | 0.60 | 0.90 | .15 Mg | 18,200 | 25.2 | 59.10 |
| 7 | 0.60 | 0.80 | — | 17,800 | 29.2 | 60.77 |
| 8 | 0.80 | 0.87 | .14 Mg | 20,100 | 25.5 | 58.05 |
| 9 | 0.80 | 0.80 | .08 Mg | 19,370 | 18.8 | 59.15 |
| 10 | 0.80 | 0.70 | — | 18,300 | 25.6 | 59.73 |
| 11 | 0.80 | 0.50 | — | 16,643 | 28.9 | 60.49 |
| 12 | 0.80 | 0.50 | misch .40 metal .4 copper | 18,000 | 20 | 59.4 |
| 13 | 0.80 | 0.35 | .3 silicon | 18,000 | 19.8 | 59.9 |
| 14 | 1.00 | 0.60 | — | 17,900 | 26.1 | 59.97 |
| 15 | 1.00 | 0.50 | — | 17,060 | 26.1 | 60.27 |
| 16 | 1.50 | 0.40 | — | 17,800 | 24.8 | 59.52 |
| 17 | 1.60 | 0.30 | — | 17,200 | 27.5 | 59.1 |

UTS = Ultimate Tensile Strength in psi
% Elong. = Percent Ultimate Elongation
% IACS = Conductivity in Percentage of IACS Through testing and analysis of an alloy containing 0.80 weight percent nickel, 0.30 weight percent iron, and the remainder aluminum, it has been found that the present aluminum base alloy after cold working includes intermetallic compound precipitates. One of the compounds is identified as nickel aluminate ($NiAl_3$) and another is identified as iron aluminate ($FeAl_3$). The nickel intermetallic compound is found to be very stable and especially so at high temperatures. The nickel compound also has a low tendency to coalesce during annealing of products formed from the alloy and the compound is generally incoherent with the aluminum matrix. The mechanism of strengthening for this alloy is in part due to the dispersion of the nickel intermetallic compound as a precipitate throughout the aluminum matrix. The precipitate tends to pin dislocation sites which are created during cold working of the wire formed from the alloy. Upon examination of the nickel intermetallic compound precipitate in a cold drawn wire, it is found that the precipitates are oriented in the direction of drawing. In addition, it is found that the precipitates can be rod-like, plate-like, or spherical in configuration.

The iron aluminate intermetallic compound also contributes to the pinning of dislocation sites during cold working of the wire. Upon examination of the iron intermetallic compound precipitates in a cold drawn wire, it is found that the precipitates are substantially evenly distributed through the alloy and have a particle size of less than 1 micron. If the wire is drawn without any intermediate anneals, the particle size of the iron intermetallic compounds is less than 2,000 angstroms.

Other intermetallic compounds may also be formed depending upon the constituents of the melt and the relative concentrations of the alloying elements. Those intermetallic compounds include the following: $Ni_2Al_3$, $Al_2Cu$, $Fe_2Al_5$, $Al_3Mg_2$, $Al_5Cu_2Mg_2$, $CeAl_4$, $CeAl_2$, $VAl_{11}$, $VAl_7$, $VAl_6$, $VAl_3$, $VAl_{12}$, $Zr_3Al$, $Zr_2Al$, $LaAl_4$, $LaAl_2$, $Al_3Ni_2$, $Al_2Fe_5$, $Fe_3NiAl_{10}$, $FeNiAl_9$.

A characteristic of high conductivity aluminum alloy wire which is not indicated by the historical tests for tensile strength, percent elongation and electrical conductivity is the possible change in properties as a result of increases, decreases or fluctuations of the temperature of the strands. It is apparent that the maximum operating temperature of a strand or series of strands will be affected by this temperature characteristic. The characteristic is also quite significant from a manufacturing viewpoint since many insulation processes require high temperature thermal cures.

It has been found that the aluminum alloy wire of the present invention has a characteristic of thermal stability which exceeds the thermal stability of conventional aluminum alloy wires.

For the purpose of clarity, the following terminology used in this application is explained as follows:

Aluminum alloy rod — A solid product that is long in lreation to its cross-section. Rod normally has a cross-section of between three inches and 0.375 inches.

Aluminum alloy wire — A solid wrought product that is long in relation to its cross-section, which is square or rectangular with sharp or rounded corners or edges, or is round, a regular hexagon or a regular octagon, and whose diameter or greatest perpendicular distance between parallel faces is between 0.374 inches and 0.0031 inches.

While this invention has been described in detail with particular reference to preferred embodiments thereof, it will be understood that variations and modifications can be effected within the spirit and scope of the invention as described hereinbefore and as defined in the appended claims.

What is claimed is:

1. An aluminum alloy electrical conductor having a minimum conductivity of 57 percent IACS consisting essentially of from about 0.20 to about 1.60 weight percent nickel, from about 0.30 to about 1.30 weight percent iron, wherein the combined weight percentage of nickel plus iron is greater than about 1.25 percent, an additional alloying element selected from the group consisting of magnesium, copper, silicon and mixtures thereof in a total amount from about 0.001 to about 0.725 percent, and the remainder being aluminum with associated trace elements.

2. The aluminum alloy electrical conductor according to claim 1 wherein said conductor is in the form of a rod.

3. The aluminum alloy electrical conductor according to claim 1 wherein said conductor is in the form of a wire.

4. The aluminum alloy electrical conductor wire of claim 3 having dispersed therein intermetallic precipitates consisting essentially of nickel aluminate and iron aluminate.

5. The aluminum alloy electrical conductor wire of claim 4 wherein said intermetallic precipitates, after cold working, are substantially aligned in the direction of drawing further strengthening said wire.

6. The method of preparing an aluminum alloy electrical conductor having a minimum conductivity of at least 57 percent IACS comprising the steps of:

A. alloying from about 0.20 to about 1.60 weight percent nickel, about 0.30 to about 1.30 weight percent iron, wherein the combined weight percentage of nickel plus iron is greater than about 1.25 percent, an additional alloying element selected from the group consisting of magnesium, copper, silicon and mixtures thereof in a total amount from about 0.001 to about 0.725 percent, and the remainder being aluminum with associated trace elements;

B. casting the alloy in a moving mold formed between a groove in the periphery of a rotating casting wheel and a metal belt lying adjacent said groove for a portion of its length;

C. hot rolling the cast alloy substantially immediately after casting while the cast alloy is in essentially that condition as cast to form a continuous rod.

7. The method of preparing an aluminum alloy conductor in accordance with claim 6 including the further step of drawing said conductor through wire-drawing dies, without annealing the conductor between drawing dies, to form wire having the following properties when measured as a fully annealed wire:

Tensile strength: at least 12,000 psi

Yield strength: at least 8,000 psi.

8. The method according to claim 7 wherein said alloy conductor wire has dispersed therein intermetallic precipitates consisting essentially of nickel aluminate and iron aluminate which are substantially aligned in the direction of drawing further strengthening the wire.

* * * * *